United States Patent [19]

Nusser

[11] Patent Number: 4,969,806

[45] Date of Patent: Nov. 13, 1990

[54] AGGREGATE FOR FEEDING FUEL FROM SUPPLY TANK TO INTERNAL COMBUSTION ENGINE OF A POWER VEHICLE

[75] Inventor: Hermann Nusser, Markgroeningen, Fed. Rep. of Germany

[73] Assignee: Robert Bosch GmbH, Stuttgart, Fed. Rep. of Germany

[21] Appl. No.: 417,874

[22] Filed: Oct. 6, 1989

[30] Foreign Application Priority Data

Jan. 7, 1989 [DE] Fed. Rep. of Germany ..... 3900263

[51] Int. Cl.[5] ..... F01C 1/10

[52] U.S. Cl. ..... 417/410; 418/152; 418/171

[58] Field of Search ..... 417/310, 311, 410; 418/171, 166, 152

[56] References Cited

U.S. PATENT DOCUMENTS

| | | | |
|---|---|---|---|
| 1,516,591 | 11/1924 | Edwards | 418/171 X |
| 1,682,564 | 8/1928 | Hill | 418/171 X |
| 1,863,335 | 6/1932 | Hill | 418/171 |
| 2,358,275 | 9/1944 | Hess | 418/171 X |
| 3,214,087 | 10/1965 | Luck | 418/171 X |
| 3,367,275 | 2/1968 | Workman | 418/171 X |
| 4,500,270 | 2/1985 | Tuckey | 418/171 X |

*Primary Examiner*—John Rivell

*Attorney, Agent, or Firm*—Michael J. Striker

[57] ABSTRACT

An aggregate for feeding fuel from a supply tank to an internal combustion engine of a power vehicle comprises an electric drive motor, a feed pump operatively connected with the drive motor and formed as an inner teeth gear pump, the feed pump including a centrally arranged toothed pinion with a predetermined number of teeth and a toothed ring with an inner toothing having a greater number of teeth than the tooth pinion and engaging with the latter, the toothed ring having an outer surface with which it is rotatably supported, the toothed pinion and the toothed ring having axes of rotation which are eccentric relative to one another, the electric drive motor having a motor armature with an axis of rotation, the axis of rotation of the toothed ring being coaxial with the axis of rotation of the motor armature.

11 Claims, 1 Drawing Sheet

AGGREGATE FOR FEEDING FUEL FROM SUPPLY TANK TO INTERNAL COMBUSTION ENGINE OF A POWER VEHICLE

BACKGROUND OF THE INVENTION

The present invention relates to a feeding aggregate for feeding fuel from a supply tank to an internal combustion engine of a power vehicle.

More particularly, it relates to such a feeding aggregate which has an electric drive motor and a feed pump which operatively cooperates with a drive motor and is formed as inner teeth gear pump including a centrally arranged toothed pinion and a toothed ring having a greater number of teeth than the toothed pinion and provided with an inner toothing and an outer guiding surface. The axis of rotation of the pinion is arranged eccentrically relative to the axis of rotation of the toothed ring.

Feeding aggregates of the above mentioned type are generally known in the art. One of such feeding aggregates is disclosed for example in the U.S. Pat. No. 4,500,270. In this patent the axial rotation of the toothed pinion coincides with the axial rotation of the motor armature. Here the guide for the toothed ring can be mounted eccentrically relative to the axis of rotation of the toothed pinion, which is very expensive due to required narrow tolerances.

SUMMARY OF THE INVENTION

Accordingly, it is an object of the present invention to provide a feeding aggregate of the above mentioned type which avoids the disadvantages of the prior art.

In keeping with these objects and with others which will become apparent hereinafter, one feature of the present invention resides, briefly stated, in an aggregate of the above mentioned type in which the axial rotation of the toothed ring is arranged coaxially with the axial rotation of the motor armature.

When the feeding aggregate is designed in accordance with the present invention it has the advantage that the eccentricity of the axis of rotation of the toothed pinion is fixed in line with the working of a housing part which belongs to the feeding aggregate so that the mounting of the feed pump requires only plugging together of the pump parts.

In accordance with another feature of the present invention, the motor armature is provided at its side facing the feed pump with a projection which is in a driving connection with an opening provided in the toothed ring.

It is also possible that several such projections are arranged in pairs on the motor armature and engage in several such recesses on the outer or guiding surface of the toothed ring.

In accordance with another feature of the present invention, three pairs of the projections and openings are provided and the openings are located approximately radially outwardly of the teeth of the toothed ring arranged between the neighboring tooth gaps.

The projection, together with the toothed ring can form a bearing for the motor armature.

The toothed pinion can be rotatably supported on a pin which is fixedly held at its one end in a housing and has a longitudinal axis concentrically extending relative to the axis of rotation of the motor armature.

The pin at its free end can be provided with a projection which is eccentric to its longitudinal axis and forms a bearing pin engaging in an axial central opening of the motor anchor.

The projection can also be formed on a synthetic plastic part which is fixedly connected with the motor armature.

Finally, the toothed ring can be supported in an opening of a guide ring connected with an aggregate housing through which the fuel flows. The toothed ring extends at its side facing towards the motor armature outwardly beyond the guiding ring and is provided at its free region with the above mentioned recess for the projection.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
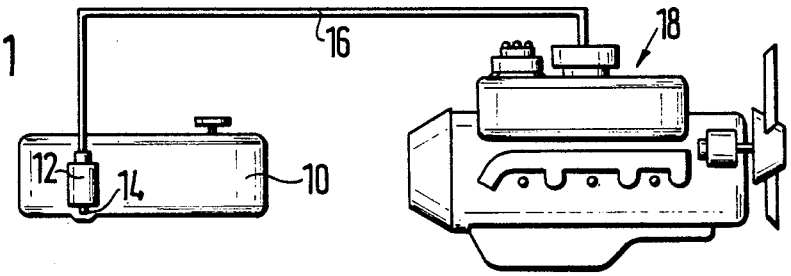
FIG. 1 is a view schematically showing an arrangement for supplying an internal combustion engine of a power vehicle with a fuel, which includes a feeding aggregate in accordance with the present invention.

FIG. 1 shows a fuel supply tank 10 in which a fuel feeding aggregate 12 is arranged. A pressure conduit 16 is connected with a pressure pipe 14 of the fuel feeding aggregate 12 and leads to a combustion engine 18 of a not shown power vehicle. During the operation of the combustion engine, the fuel feeding aggregate 12 feeds the fuel from the supply tank 10 to the internal combustion engine 18.

Figure 2:
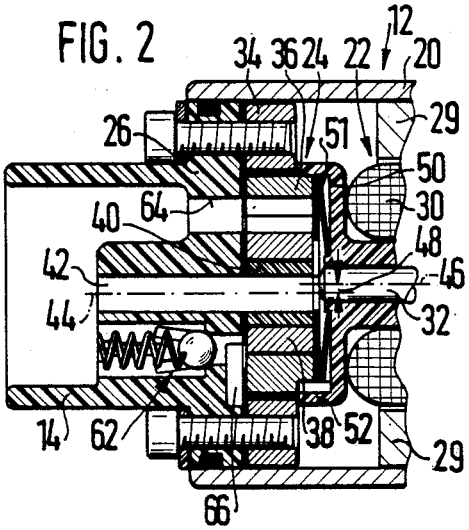
FIG. 2 is a view showing a partial longitudinal section of the feeding aggregate on an enlarged scale.

The feeding aggregate 12 shown in FIG. 2 has a tubular housing 20. An electric drive motor 22 and a feeding pump 24 formed as an inner teeth gear pump are arranged in the tubular housing 20. One opening of the tubular housing 20 is closed with a cover 26. The cover is composed of synthetic plastic material and plugged in the tubular housing 20 by braces 28 shown in FIG. 4. The electric drive motor 22 has permanent magnets 29 formed on the inner wall of the tubular housing 20 which is composed of a ferromagnetic material. The permanent magnets 29 are segment-shaped and surround a motor armature 30 which is a part of the electric drive motor 22. The motor armature 30 is mounted on an armature shaft 32 which is rotatably supported in a not shown housing part connected with the braces 28. It is however recommended that the armature shaft 32 be formed as a housing-fixed rigid axle on which the armature is rotatably supported.

Figure 3:
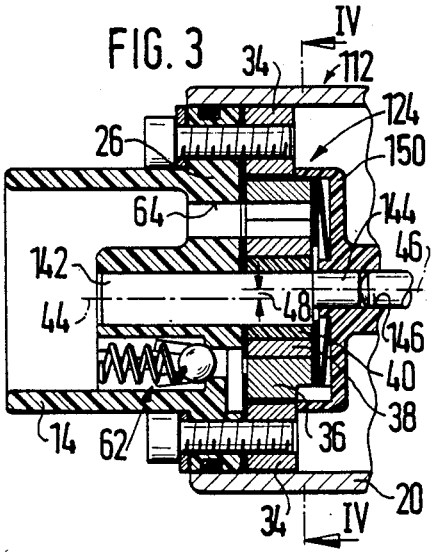
FIG. 3 is a view showing a partial longitudinal section corresponding to the view of FIG. 2, but showing another embodiment of the feed aggregate of the present invention.
Figure 4:
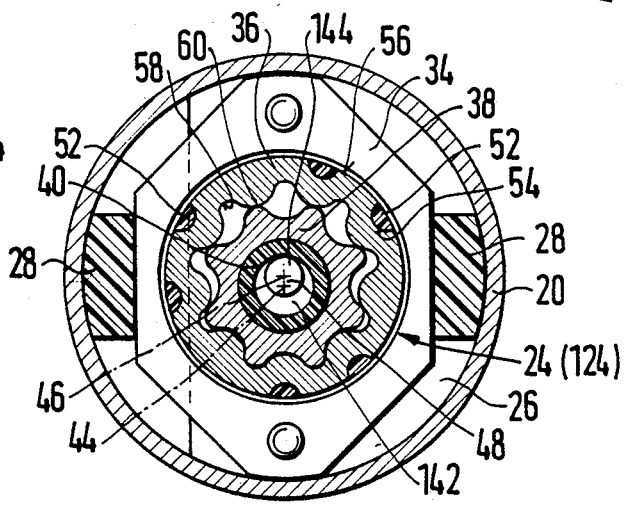
FIG. 4 is a view showing a cross-section through the feeding aggregate of FIG. 3, taken along the line IV—IV with a bearing pin for a toothed pinion of a feed pump, on an enlarged scale.

The feed pump 24 is illustrated in FIG. 4, which is a section of FIG. 2. It shows the structural elements which are provided in the feed pump 24 of FIG. 2 and also in a feed pump 124 of FIG. 3. The feed pump 24 is formed as an inner teeth gear pump and has a guiding ring 34 fixedly connected with the housing part 26. An inner toothed ring 36 is rotatably supported in an opening of the guiding ring 34. A toothed pinion 38 is arranged inside the toothed ring 36 and has a toothing which engages with the inner toothing of the toothed ring 36. The toothed pinion 38 has a carbon bearing bush 40, through a bearing pin 42 shown in FIG. 2 extends. The bearing pin 42 is fixedly connected with the housing part 26.

As can be seen further in FIG. 4, an axis of rotation 44 of the pinion 38 is arranged eccentrically to an axis of rotation 46 of the toothed ring 36. Thereby an eccentricity 48 is produced between the axes of rotation of the toothed ring and the pinion. This eccentricity can be also seen in FIGS. 2 and 3 of the drawings. It can be also seen from FIG. 2 that the toothed ring 36, the toothed pinion 38 and the bearing bush 40 extend outwardly beyond the guiding ring 34 in direction toward the motor armature 30. FIG. 2 also shows that a synthetic plastic part 50 is fixedly connected with the motor armature 30. The synthetic plastic part 50 is formed as a flange and provided on its peripheral region with a plurality of projections 52 extending in direction of the axis of rotation of the motor armature 30 and toward the pump 24.

The projections 52 are arranged so that they engage in semi-circular recesses 54 formed on an outer surface 56 of the toothed ring 30 and open at its edge. In the arrangement shown in FIG. 4 six projections 52 are provided. They are arranged in pairs and their inwardly associated recesses 54 in the toothed ring are located substantially radially outwardly of the teeth 60 of the toothed ring 36 formed between the neighboring teeth haps 58. The projections 62 of the synthetic part 50 extend in the embodiment of FIG. 2 to the guiding ring 34. To complete the construction a pressure control valve 62 is arranged in the cover 26.

A sealing unit 51 is mounted between the flange-like synthetic plastic part 50 of the motor armature 30 and the parts 40, 38, 36 of the pump 24 which rotates during the operation. The sealing unit can be formed for example as disclosed in the U.S. Pat. No. 4,500,270 to which a reference is made here so that the description of the sealing unit can be dispensed with.

The feeding aggregate in accordance with the present invention operates in the following manner:

The electric drive motor 12 drives the toothed ring 36 of the inner teeth gear pump 24 through the synthetic plastic part 50 operating as a rotary coupling and through its projections 52. The inner toothing of the inner teeth gear pump 24 take along the toothed pinion 38 and rotate the same together with the bearing bush 40 on the bearing pin 42. The interengaging toothings of the toothed pinion 38 and the toothed ring 36 limit increasing and reducing pump chambers which aspirate the fuel in a known manner through a suction opening 64 in the cover 26. The medium to be fed leaves the inner teeth gear pump 24 under pressure, flows in a recess 66 in the housing part 34 and then flows outside of the guiding ring 34 in FIG. 4 through the tubular housing 2 to a not shown pressure pipe of the feeding aggregate 12, from which it reaches the pressure opening 16 in FIG. 1.

The feeding aggregate shown in FIG. 3 substantially corresponds to the feeding aggregate of FIG. 2. Similar parts are identified with the same reference numerals as in FIG. 2. In deviation from the embodiment shown in FIG. 2, a bearing pin 142 corresponding to the bearing pin 42 is provided at its free end with a projection 144 which is eccentric to its longitudinal axis 44. The eccentricity of the projections 44 is dimensioned and determined so that the longitudinal axis of the eccentric projection 144 extends coaxially to the axis of rotation 46 of the motor armature 30. Eccentric projection 144 of the bearing pin 142 engages in a central opening 146 of the synthetic plastic part 150 which is a part of a motor armature. The central opening 146 is concentric to the axis of rotation of the motor armature.

Both embodiments have a common feature in that the axis of rotation 46 of the toothed ring is coaxial to the axial rotation of the motor armature 30. Thereby an especially simple mounting of the inner teeth gear pump 24 is achieved.

A substantial difference between the embodiments of FIGS. 2 and 3 is that in FIG. 2 the motor armature 30 is supported through the projections 52 substantially on the toothed ring 36, while in the embodiment of FIG. 3, the support of the motor armature is provided substantially through the eccentric projection 144 of the bearing pin 142 in the synthetic plastic part 150 to the armature. Another substantial part of the support armature is provided in both embodiments by the armature shafts 32 which in turn are supported in a not shown end region in the housing part of the feeding aggregate 12.

It will be understood that each of the elements described above, or two or more together, may also find a useful application in other types of constructions differing from the types described above.

While the invention has been illustrated and described as embodied in an aggregate for feeding fuel from a supply tank to an internal combustion engine of a power vehicle, it is not intended to be limited to the details. shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. An aggregate for feeding fuel from a supply tank to an internal combustion engine of a power vehicle, comprising an electric drive motor; a feed pump operatively connected with said drive motor and formed as an inner teeth gear pump, said feed pump including a centrally arranged toothed pinion with a predetermined number of teeth and a toothed ring with an inner toothing having a greater number of teeth than said tooth pinion and engaging with the latter, said toothed ring having an outer surface with which it is rotatably supported, said toothed pinion and said toothed ring having axes of rotation which are eccentric relative to one another, said electric drive motor having a motor armature with an axis of rotation, said axis of rotation of said toothed ring being coaxial with said axis of rotation of said motor armature, said toothed ring being provided with an opening, said motor armature has a side facing toward said feed pump and provided with a projection which forms a drive coupling with said opening, said toothed ring having a plurality of such openings, said motor armature having a plurality of such projections which extend in direction of said axis of rotation of said armature and engage in said openings.

2. An aggregate as defined in claim 1, wherein said toothed ring has an edge, said opening being open at the edge of said toothed ring.

3. An aggregate as defined in claim 1, wherein said projections of said motor armature are arranged in pairs.

4. An aggregate as defined in claim 1, wherein said toothed ring has an outer surface, said openings being formed in said outer surface of said toothed ring.

5. An aggregate as defined in claim 1, wherein said toothed ring has a guiding surface, said openings being formed in said guiding surface of said toothed ring.

6. An aggregate as defined in claim 1, wherein said projections and openings include three pairs of such projections and openings, said toothed ring has a plurality of teeth separated from one another by toothed gaps, said openings being arranged at least approximately radially outside of said teeth of said toothed ring.

7. An aggregate as defined in claim 1; and further comprising a pin having a longitudinal axis extending eccentrically relative to said axis of rotation of said motor armature and fixed at its one end, said toothed pinion being rotatably supported on said pin.

8. An aggregate as defined in claim 1; and further comprising a synthetic plastic part fixedly connected with said motor armature, said projection being formed on said synthetic plastic part.

9. An aggregate for feeding fuel from a supply tank to an internal combustion engine of a power vehicle, comprising an electric drive motor; a feed pump operatively connected with said drive motor and formed as an inner teeth gear pump, said feed pump including a centrally arranged toothed pinion with a predetermined number of teeth and a toothed ring with an inner toothing having a greater number of teeth than said tooth pinion and engaging with the latter, said toothed ring having an outer surface with which it is rotatably supported, said toothed pinion and said toothed ring having axes of rotation which are eccentric relative to one another, said electric drive motor having a motor armature with an axis of rotation, said axis of rotation of said toothed ring being coaxial with said axis of rotation of said motor armature, said toothed ring being provided with an opening, said motor armature has a side facing toward said feed pump and provided with a projection which forms a drive coupling with said opening, said projection together with said toothed ring forming a bearing for said motor armature.

10. An aggregate for feeding fuel from a supply tank to an internal combustion engine of a power vehicle, comprising an electric drive motor; a feed pump operatively connected with said drive motor and formed as an inner teeth gear pump, said feed pump including a centrally arranged toothed pinion with a predetermined number of teeth and a toothed ring with an inner toothing having a greater number of teeth than said tooth pinion and engaging with the latter, said toothed ring having an outer surface with which it is rotatably supported, said toothed pinion and said toothed ring having axes of rotation which are eccentric relative to one another, said electric drive motor having a motor armature with an axis of rotation, said axis of rotation of said toothed ring being coaxial with said axis of rotation of said motor armature; a pin having a longitudinal axis extending eccentrically relative to said axis of rotation of said motor armature and fixed at its one end, said toothed pinion being rotatably supported on said pin, said pin having a free end which is provided with a projection eccentric to said longitudinal axis, said motor armature having a central opening which is coaxial to said axis of rotation of said motor armature, said projection of said free end of said pin engaging in said central opening of said motor armature and acting as a bearing pin.

11. An aggregate for feeding fuel from a supply tank to an internal combustion engine of a power vehicle, comprising an electric drive motor; a feed pump operatively connected with said drive motor and formed as an inner teeth gear pump, said feed pump including a centrally arranged toothed pinion with a predetermined number of teeth and a toothed ring with an inner toothing having a greater number of teeth than said tooth pinion and engaging with the latter, said toothed ring having an outer surface with which it is rotatably supported, said toothed pinion and said toothed ring having axes of rotation which are eccentric relative to one another, said electric drive motor having a motor armature with an axis of rotation, said axis of rotation of said toothed ring being coaxial with said axis of rotation of said motor armature, said toothed ring being provided with an opening, said motor armature has a side facing toward said feed pump and provided with a projection which forms a drive coupling with said opening; a housing through which a fuel flows; a guiding ring fixedly connected with said housing and having an opening, said toothed ring being supported in said opening of said guide ring, said toothed ring at its side facing toward said motor armature extending outwardly beyond said guiding ring and said opening for said projection being arranged at least in its free region.

* * * * *